US005087325A

United States Patent [19]

Page

[11] Patent Number: 5,087,325

[45] Date of Patent: Feb. 11, 1992

[54] APPARATUS FOR MANUFACTURING A DRIED WEB OF PAPER

[75] Inventor: Robert E. Page, Davis, Ill.

[73] Assignee: Beloit Corporation, Beloit, Wis.

[21] Appl. No.: 668,536

[22] Filed: Mar. 13, 1991

[51] Int. Cl.[5] ..... D21F 2/00; D21F 3/04

[52] U.S. Cl. ..... 162/193; 162/194; 162/203; 162/205; 162/306; 162/359; 162/360.1

[58] Field of Search ..... 162/301, 306, 358, 359, 162/360.1, 255, 286, 193, 194, 203, 205, 207

[56] References Cited

U.S. PATENT DOCUMENTS

| | | | |
|---|---|---|---|
| 2,714,342 | 8/1955 | Beachler | 162/370 |
| 4,483,745 | 11/1984 | Wicks et al. | 162/360.1 |
| 4,648,942 | 3/1987 | Wanke et al. | 162/359 |
| 4,874,470 | 10/1989 | Skaugen | 162/359 |
| 4,879,001 | 11/1989 | Cronin | 162/360.1 |
| 4,976,821 | 11/1990 | Lagpotti | 162/360.1 |

*Primary Examiner*—Karen M. Hastings
*Attorney, Agent, or Firm*—Dirk J. Veneman; Raymond W. Campbell; David J. Archer

[57] ABSTRACT

An apparatus includes a forming section for forming a web from stock. The apparatus also includes a press section which is disposed downstream relative to the forming section for removing a portion of water from the formed web. The press section includes a suction pick-up roll disposed downstream relative to the forming section for picking up the formed web from the forming section. A press felt extends around the suction pick-up roll such that in use of the apparatus, the formed web is picked up from the forming section and is supported by the press felt. An extended nip press is disposed downstream relative to the pick-up means. The press includes a rotatable backing roll and a pressing shoe which cooperates with the backing roll for defining therebetween an elongate pressing section. A bearing blanket movably extends through the pressing section with the blanket cooperating with the suction pick-up roll such that the formed web is transferred from the press felt to the blanket. The apparatus also includes a dryer section which includes a rotatable dryer having a heated surface which cooperates with the blanket such that the pressed web is transferred from the blanket to the heated surface of the dryer. A dryer felt extends around a portion of the heated surface which is disposed downstream relative to the blanket such that the web is sandwiched between the dryer felt and the dryer.

17 Claims, 4 Drawing Sheets

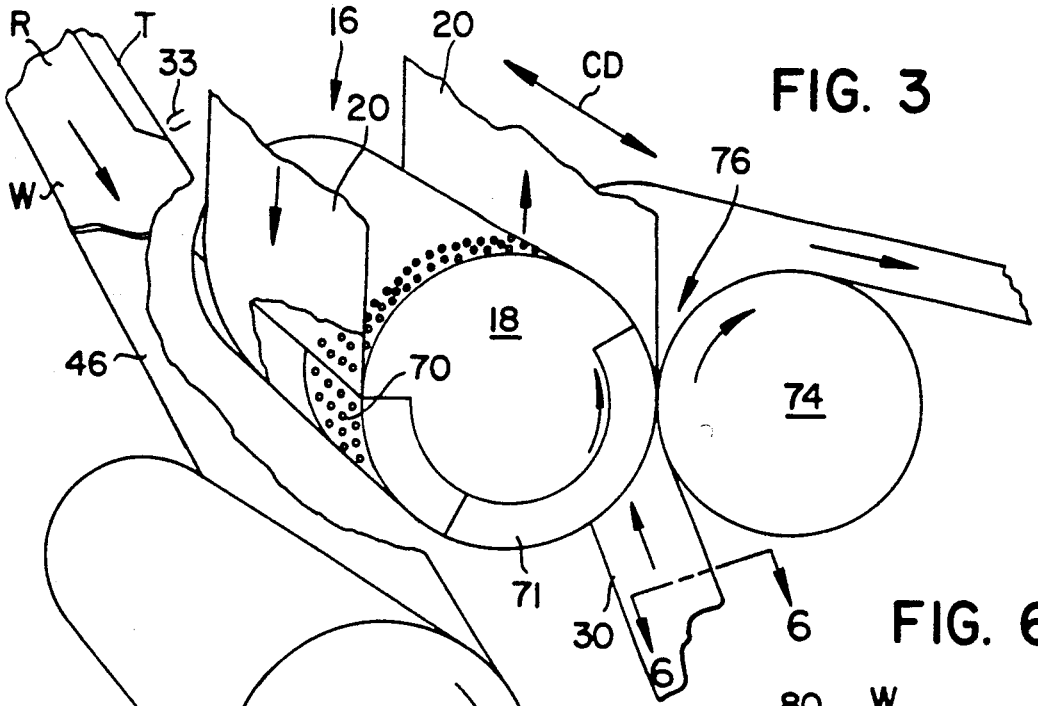
FIG. 3
FIG. 6
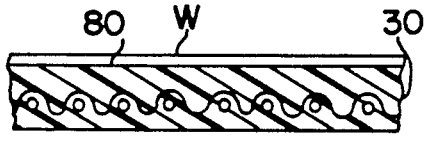
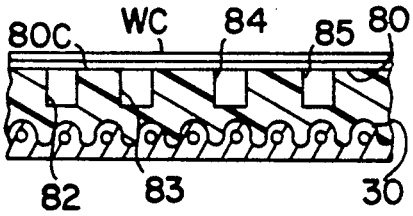
FIG. 7
FIG. 4
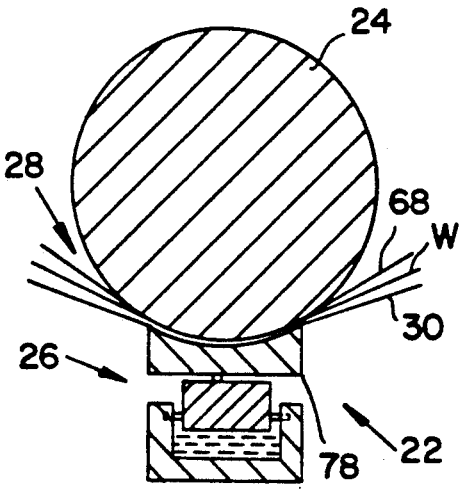
FIG. 5
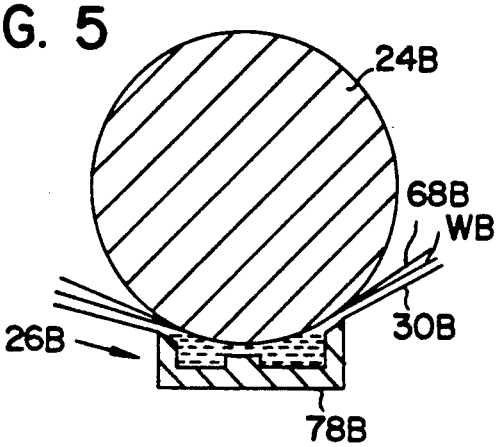

APPARATUS FOR MANUFACTURING A DRIED WEB OF PAPER

BACKGROUND OF THE INVENTION

1. Field of the Invention

The present invention relates to an apparatus for manufacturing a dried web of paper from stock. More particularly, the present invention relates to an apparatus in which the web is positively supported during passage through the apparatus from the forming section to the dryer section.

2. Information Disclosure Statement

With the increased demand for paper and board, there exists not only a need for increased paper width production but also an increase in the actual speed at which a paper machine will operate.

More specifically, although it is possible to increase the width of a paper machine so that more tonnage per year can be produced, there exists a theoretical limit to the width of a papermaking machine. Various roll deflection compensating arrangements have been proposed which endeavor to compensate for the relative bowing between cooperating press rolls and the like. However, when cross-machine widths above 40 feet are employed, such compensation is difficult to control.

Accordingly, there has existed a trend towards increased machine speed such that machine speeds up to 10,000 feet per minute are contemplated.

In conventional papermaking machines, which operate at approximately 1,000–4,000 feet per minute, the existence of open draws has presented relatively few problems. However, as machine speeds increase, the provision of an open draw between the press section and the dryer section has introduced problems in that the relatively fragile web emerging from the press section tends to flutter during transfer from the press section into the dryer section.

Furthermore, in the event of web breakage, traditionally, the sheet is removed from the dryer section and a tail of the web is cut upstream relative to the press section. Such tail must then be manually or semi-automatically threaded from the press section into the dryer section.

Accordingly, there has existed the need of a papermaking machine having no open draw between the press section and the dryer section so that web flutter is inhibited and so that a tail can be automatically threaded into the dryer section.

Therefore, it is a primary objective of the present invention to overcome the inadequacies of the prior art devices and to provide an apparatus which makes a considerable contribution to the art of manufacturing a dried web of paper from stock.

Another object of the present invention is the provision of an apparatus which includes a forming section and a press section disposed downstream relative to the forming section. The press section includes an extended nip press having a bearing blanket which movably extends through the pressing section, the blanket cooperating with a suction pick-up roll to form a first press such that the formed web is transferred from a press felt to the blanket, the web thereafter extending through the pressing section for removing more water from the web.

Another object of the present invention is the provision of an apparatus which includes a dryer section disposed downstream relative to the press section, the dryer section including a rotatable dryer having a heated surface which cooperates with the blanket such that the pressed web is transferred from the blanket to the heated surface of the dryer.

Another object of the present invention is the provision of an apparatus in which the dryer section includes a dryer felt which extends around a portion of the heated surface, the portion being disposed downstream relative to the blanket such that the web is sandwiched between the dryer felt and the dryer.

Other objects and advantages of the present invention will be apparent to those skilled in the art by a consideration of the detailed description contained hereinafter taken in conjunction with the annexed drawings.

SUMMARY OF THE INVENTION

The present invention relates to an apparatus and method for manufacturing a dried web of paper from stock, the web being positively supported during passage through the apparatus.

The apparatus includes a forming section for forming the web from stock. Additionally, the apparatus includes a press section which is disposed downstream relative to the forming section for removing a portion of water from the formed web. The press section includes pick-up means disposed downstream relative to the forming section for picking up the formed web from the forming section. The pick-up means also includes a suction pick-up roll and a press felt which extends around the suction pick-up roll such that in use of the apparatus, the formed web is picked up from the forming section and is supported by the press felt.

The press section also includes an extended nip press means which is disposed downstream relative to the pick-up means for removing a part of the portion of water from the formed web.

The press means also includes a rotatable backing roll and a pressing means which cooperates with the backing roll for defining therebetween an elongate pressing section. A bearing blanket movably extends through the pressing section. The blanket cooperates with the suction pick-up roll such that the formed web is transferred from the press felt to the blanket. The web thereafter extends through the pressing section for removing a part of the portion of water from the web.

The apparatus also includes a dryer section which is disposed downstream relative to the press section for drying the pressed web. The dryer section includes a rotatable dryer having a heated surface which cooperates with the blanket such that the pressed web is transferred from the blanket to the heated surface of the dryer. Additionally, the dryer section includes a dryer felt which extends around a portion of the heated surface. The portion is disposed downstream relative to the blanket such that the web is sandwiched between the dryer felt and the dryer.

In a more specific embodiment of the present invention, an apparatus for manufacturing a dried web of paper from stock positively supports the web during passage through the apparatus. The apparatus includes a forming section for forming the web from the stock. The forming section includes a headbox and a first and second moving endless looped forming wire which cooperate together to define therebetween a forming section. The forming section has an upstream and a downstream end. The upstream end is disposed closely adjacent to the headbox for receiving the stock ejected therefrom. A dewatering means progressively removes a first and second portion of water from the stock as the stock moves through the forming section. The first and the second portions of water are removed through the first and second wires respectively. A transfer means is disposed adjacent to the downstream end of the forming section for positively urging the formed web into close conformity with the second wire when the wires diverge relative to each other.

The apparatus also includes a press section which is disposed downstream relative to the forming section for removing a third portion of water from the formed web. The press section includes a pick-up means which is disposed downstream relative to the transfer means for picking up the formed web from the second wire. The pick-up means includes a suction pick-up roll and a press felt which extends around the suction pick-up roll such that in use of the apparatus, the formed web is picked up from the second wire and is supported by the press felt. The press section also includes an extended nip press means which is disposed downstream relative to the pick-up means for removing some of the third portion of water from the formed web. More particularly, the press means includes a rotatable backing roll and a pressing means which cooperates with the backing roll for defining therebetween an elongate pressing section. A bearing blanket movably extends through the pressing section. The blanket cooperates with the suction pick-up roll such that the formed web is transferred from the press felt to the blanket. The web thereafter extends through the pressing section for removing some of the third portion of water from the web.

The dryer section includes a rotatable dryer having a heated surface which cooperates with the blanket such that the pressed web is transferred from the blanket to the heated surface of the dryer. Additionally, the dryer section includes a dryer felt which extends around a portion of the heated surface. The portion is disposed downstream relative to the blanket such that the web is sandwiched between the dryer felt and the dryer. A vacuum transfer means is disposed downstream relative to the dryer for guiding the dryer felt and web supported thereon away from the dryer. Also, the dryer section includes a further dryer disposed downstream relative to the vacuum transfer means. The dryer felt and the web move contiguously relative to each other from the vacuum transfer means to the further dryer. The dryer and the further dryer are disposed in a single tier. The arrangement is such that the web is positively supported from the upstream end of the forming section to the further dryer for permitting automatic threading of the web through the press and dryer sections.

In one embodiment of the present invention, the forming section includes a first and second turning bar which are disposed respectively within a loop formed by the first and second wires respectively. The turning bars are disposed closely adjacent to the headbox and the upstream end of the forming section.

The dewatering means also includes a dewatering shoe which is disposed within a loop defined by the second wire.

The transfer means includes a suction roll which is disposed within a loop defined by the second wire. The suction roll is disposed adjacent to the downstream end of the forming section such that when the wires diverge relative to each other, the formed web is urged into conformity with the second wire while some of the first portion of water is removed from the formed web centrifugally through the first wire during passage of the formed web around the suction roll.

The press section also includes a further press felt which extends through the pressing section such that the formed web is sandwiched between the blanket and the further press felt during passage of the formed web through the elongate pressing section.

The suction pick-up roll also includes a tail box which extends across a portion of the cross-machine directional width of the suction pick-up roll for picking up a tail of the formed web from the second wire. The tail is supported by the press felt and thereafter is transferred from the press felt to the bearing blanket for threading through the elongate pressing section.

The press section also includes a broke pit which is disposed beneath the suction pick-up roll such that when the tail is cut from the formed web supported by the second wire, the remainder of the full width formed web is removed through the broke pit while the tail follows the press felt.

The extended nip press means also includes an upstream guide roll for guiding the bearing blanket. The upstream guide roll and the suction pick-up roll define therebetween a transfer nip or first press nip such that the formed web is sandwiched between the press felt and the bearing blanket during passage through the transfer nip.

The bearing blanket defines a smooth, water impervious surface for supporting the formed web such that the web is transferred from the press felt to the smooth surface of the bearing blanket when the bearing blanket diverges relative to the press felt.

In one embodiment of the present invention, the pressing means is a hydrodynamic shoe.

In another embodiment of the present invention, the pressing means is a hydrostatic shoe.

In an alternative embodiment of the present invention, the bearing blanket defines a surface for supporting the formed web, the surface defining a plurality of recesses therein for the reception of water removed from the formed web during passage of the web through the elongate pressing section.

In one embodiment of the present invention, the press section further includes a downstream guide roll for guiding the bearing blanket away from the elongate pressing section. The downstream guide roll cooperates with the heated surface of the dryer such that the downstream guide roll and the dryer define therebetween a dryer transfer nip or smoothing press nip for the passage therethrough of the pressed web supported by the bearing blanket.

The dryer section further includes a doctor which cooperates with the heated surface. The doctor is disposed downstream of the portion of the heated surface and upstream relative to the blanket. The arrangement is such that in use of the apparatus, when a tail of the formed web is cut from the full width web supported by the second wire upstream relative to the suction pick-up roll, the tail is threaded through the press section. The tail thereafter transfers from the bearing blanket to the heated surface when the bearing blanket diverges relative to the heated surface. Subsequently, the tail is supported by the heated surface and is thereafter sandwiched between the dryer felt and the dryer. The doctor is provided with an air nozzle means such that when the doctor is in an operative position, the tail is doctored from the dryer section and is blown by the air nozzle so that the tail is threaded through the remainder of the dryer section.

Additionally, the dryer section further includes a further broke pit which is disposed beneath the downstream guide roll and dryer such that in the event of a web breakage during passage of the pressed web through the dryer section, a tail cutter disposed above the second wire moves in a cross-machine direction so that the web is cut transversely. Simultaneously, vacuum to the suction pick-up roll is cut off so that the web falls into the broke pit rather than being transferred to the blanket. The arrangement is such that the full width web from the forming section is removed through the broke pit so that when the web breakage in the dryer section has been attended to, a further tail can be cut in from an edge of the web on the second wire, such further tail can then be threaded through the press section and the dryer section when vacuum is again applied to the tail box.

The present invention also includes a method for manufacturing a dried web of paper from stock, the web being positively supported during passage through the apparatus. The method includes the steps of: forming a web from stock such that the formed web is disposed on a forming wire of the forming section and cutting a tail of the web on the forming wire upstream relative to a pick-up roll of the press section. The tail of the web is then picked up by applying vacuum through a tail box defined by the pick-up roll such that the tail is supported by a press felt while the remainder of the full width web is removed to a broke pit.

The tail is transferred to a smooth, impervious surface of a bearing blanket which extends through an extended nip press.

The tail is supported on the impervious surface during passage of the tail through an elongate pressing section, and the tail is transferred from the bearing blanket to a heated surface of a dryer.

The tail is then sandwiched between the dryer and a dryer felt disposed downstream relative to the bearing blanket such that the tail is threaded through the press section and the dryer section.

Subsequently, the tail is widened to a full width web such that the full width web is threaded through the press section and dryer section, the web being transferred without open draw from the forming section to the dryer section.

In addition, in the event of a web breakage occurring in the dryer section, the method includes the further steps of: moving a tail cutter in a cross-machine direction across the second wire and simultaneously or previously disconnecting vacuum from the pick-up roll such that the full width web falls from the pick-up roll into the broke pit.

The broken web is then removed from the dryer section, and the vacuum is again applied to the pick-up roll. A further tail is next cut from the full width web on the forming wire.

Thereafter, the further tail supported on the press felt by means of the tail box is threaded through the press section and dryer section. The further tail is then widened to a full width web such that the full width web is guided through the dryer section.

Many modifications and variations of the present invention will be readily apparent to those skilled in the art by a consideration of the detailed description taken in conjunction with the annexed drawings. However, such modifications and variations do not depart from the spirit and scope of the present invention as defined by the appended claims. Included in such modifications and variations would be a papermaking machine in which the downstream guide roll is provided with a swing arm mechanism such that the guide roll is mounted to swing relative to the drying cylinder. Loading means is provided for removably loading the guide roll against the dryer cylinder during normal operation. The swing arm mechanism could be replaced by a self-loading crown compensating roll.

Upon a sheet break in the dryer section, the guide roll would be unloaded. The sheet from the elongate press section would then follow the impervious surface of the bearing blanket and would be doctored from the blanket at a location downstream of the open nip defined between the guide roll and the drying cylinder.

Accordingly, the full width web or sheet would be doctored into a further broke pit or pulper from the aforementioned blanket doctor.

When the dryer section has been cleared, the guide roll is moved towards the dryer such that a narrow gap is defined between the guide roll and the dryer. A tail is then cut on the forming wire. The tail between the downstream guide roll and the blanket doctor is then blown by air transfer means so that the tail is engaged between the dryer felt and the dryer. When the tail has been threaded through the dryer section, the tail cutter is moved across the web so that the full width web moves through the press section and proceeds through a narrow open draw between the downstream guide roll and the dryer into the dryer section. Thereafter, the guide roll is loaded into nipping relationship with the dryer.

In a further variation of the present invention, the guide roll is swung away from the dryer cylinder to define an open nip arrangement. The blanket doctor is then moved into an operative position relative to the blanket. The tail cutter is then moved across the web on the forming wire so that the full width web follows the blanket and is doctored therefrom by the blanket doctor into the further broke pit.

The guide roll is then loaded against the drying cylinder, and a tail is then cut from the edge of the web on the second wire of the forming section. When the tail passes through the smoothing press nip defined between the blanket and the drying cylinder, the tail automatically follows the drying cylinder while the remainder of the web follows the smooth surface of the blanket and is doctored to the further broke pit. Thereafter, the tail is widened out to the full width of the sheet so that the full width web follows and is transferred to the heated surface of the dryer cylinder when the web emerges from the smoothing press nip. Subsequently, the blanket doctor is moved out of operative engagement with the blanket.

It is to be understood that in each of the embodiments of the present invention, a first press nip is defined between the suction pick-up roll and an upstream guide roll of the press section. The pressing means and rotatable backing roll define a second press nip, and the downstream guide roll and cooperating dryer define a third press nip. Also, instead of the pick-up roll, a pick-up shoe could be used.

BRIEF DESCRIPTION OF THE DRAWINGS

FIG. 3 is an enlarged perspective view of the suction pick-up roll and first press means according to the present invention;

FIG. 4 is a sectional view of part of the press means according to the present invention showing a hydrodynamic shoe;

FIG. 5 is a view similar to that shown in FIG. 4 but shows a hydrostatic shoe;

FIG. 6 is an enlarged sectional view taken on the line 6—6 of FIG. 3 and shows the bearing blanket according to the present invention;

FIG. 7 is a similar view to that shown in FIG. 6 but shows the blanket having a surface defining a plurality of recesses therein.

Similar reference characters refer to similar parts throughout the various embodiments of the present invention.

DETAILED DESCRIPTION OF THE DRAWINGS

Figure 1:
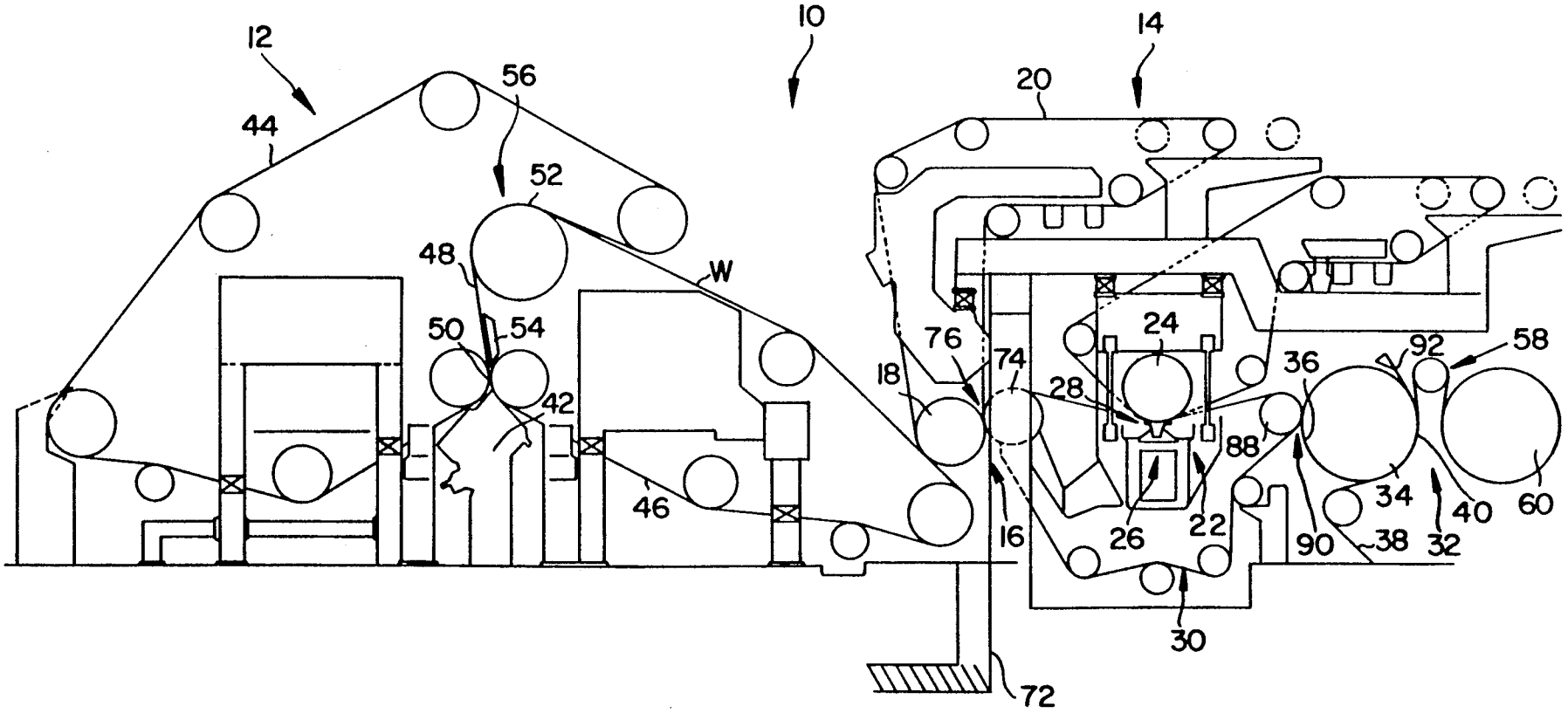
FIG. 1 is a side-elevational view of an apparatus for manufacturing a dried web of paper from stock according to the present invention.

FIG. 1 is a side-elevational view of an apparatus generally designated 10 according to the present invention for manufacturing a dried web of paper W from stock, the web W being positively supported during passage through the apparatus 10. The apparatus 10 includes a forming section generally designated 12 for forming the web W from the stock.

The apparatus 10 also includes a press section generally designated 14 which is disposed downstream relative to the forming section 12 for removing water from the formed web W. The press section 14 includes pick-up means generally designated 16 disposed downstream relative to the forming section 12 for picking up the formed web W from the forming section 12. The pick-up means 16 includes a suction pick-up roll 18 and a press felt 20 which extends around the suction pick-up roll 18 such that in use of the apparatus 10, the formed web W is picked up from the forming section 12 and is supported by the press felt 20.

An extended nip press means generally designated 22 is disposed downstream relative to the pick-up means 16 for removably part of a portion of water from the formed web W. More particularly, the press means 22 includes a rotatable backing roll 24 and a pressing means generally designated 26 which cooperates with the backing roll 24 for defining therebetween an elongate pressing section 28. A bearing blanket generally designated 30 movably extends through the pressing section 28. The blanket 30 cooperates with the suction pick-up roll 18 such that the formed web W is transferred from the press felt 20 to the blanket 30. The web W thereafter extends through the pressing section 28 for removing the part of the portion of water from the web W.

The apparatus 10 also includes a dryer section generally designated 32 which is disposed downstream relative to the press section 14 for drying the pressed web W. The dryer section 32 includes a rotatable dryer 34 which defines a heated surface 36 which cooperates with the blanket 30 such that the pressed web W is transferred from the blanket 30 to the heated surface 36 of the dryer 34. The dryer section 32 also includes a dryer felt 38 which extends around a portion 40 of the heated surface 36. The portion 40 is disposed downstream relative to the blanket 30 such that the web W is sandwiched between the dryer felt 38 and the dryer 34.

More specifically, FIG. 1 shows the apparatus 10 for manufacturing the web W from stock, the web W being positively supported during passage through the apparatus 10. The apparatus 10 includes the forming section 12 for forming the web W from the stock. The forming section 12 includes a headbox 42 and a first and a second moving endless looped forming wire 44 and 46 respectively which cooperate together to define therebetween a forming section 48. The forming section 48 has an upstream and a downstream end 50 and 52 respectively. The upstream end 50 is disposed closely adjacent to the headbox 42 for receiving the stock ejected therefrom.

The forming section 48 also includes a curved dewatering means generally designated 54 disposed between the upstream and downstream ends 50 and 52 respectively for progressively removing a first and a second portion of water from the stock moving through the forming section 48. First and the second portions of water are removed through the first and second wires 44 and 46 respectively.

The forming section 12 also includes a transfer means generally designated 56 disposed adjacent to the downstream end 52 of the forming section 12 for positively urging the formed web W into close conformity with the second wire 46 when the wires 44 and 46 diverge relative to each other.

The press section 14 is disposed downstream relative to the forming section 12 for removing a third portion of water from the formed web W. The press section 14 includes the pick-up means 16 which is disposed downstream relative to the transfer means 56 for picking up the formed web W from the second wire 46.

The pick-up means 16 includes the suction pick-up roll 18 and the press felt 20 which extends around the suction pick-up roll 18 such that in use of the apparatus, the formed web W is picked up from the second wire 46 and is supported by the press felt 20.

The extended nip press means 22 is disposed downstream relative to the pick-up means 16 for removing a third portion of water from the formed web W.

The press means 22 includes the rotatable backing roll 24 and the pressing means 26 which cooperates with the backing roll 24 for defining therebetween the elongate pressing section 28. The bearing blanket 30 movably extends through the pressing section 28. The blanket 30 cooperates with the suction pick-up roll 18 such that the formed web W is transferred from the press felt 20 to the blanket 30. The web W thereafter extends through the pressing section 28 for removing a part of the third portion of water from the web W.

The dryer section 32 is disposed downstream relative to the press section 14 for drying the pressed web W. The dryer section 32 includes the rotatable dryer 34 which defines the heated surface 36 which cooperates with the blanket 30 such that the pressed web W is transferred from the blanket 30 to the heated surface 36 of the dryer 34. The dryer felt 38 extends around the portion 40 of the heated surface 36. The portion 40 is disposed downstream relative to the blanket 30 such that the web W is sandwiched between the dryer felt 38 and the dryer 34. A vacuum transfer means generally designated 58 is disposed downstream relative to the dryer 34 for guiding the dryer felt 38 and the web W supported thereon away from the dryer 34. A further dryer 60 is disposed downstream relative to the vacuum transfer means 58. The dryer felt 38 and the web W move contiguously relative to each other from the vacuum transfer means 58 to the further dryer 60. The dryer 34 and the further dryer 60 are disposed as a single tier, the arrangement being such that the web W is positively supported from the upstream end 50 of the forming section 12 to the further dryer 60 for permitting automatic threading of the web W through the press and dryer sections 14 and 32 respectively.

Figure 2:
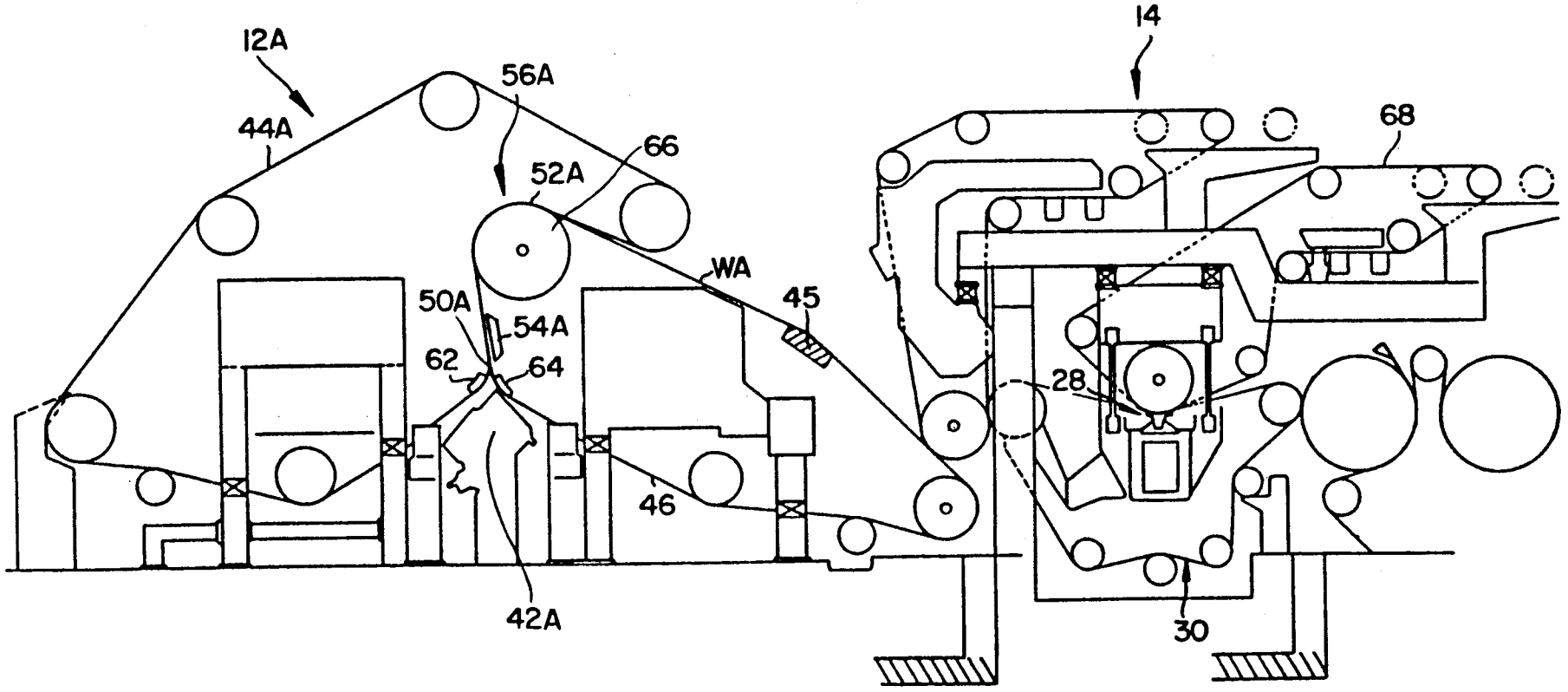
FIG. 2 is a similar view to that shown in FIG. 1 but shows an alternative embodiment of the present invention including turning bars within the forming section.

FIG. 2 is an elevational view similar to that shown in FIG. 1 but shows a further embodiment of the present invention in which the forming section 12A further includes a first and second turning bar 62 and 64 respectively disposed within a loop formed by the first and the second wires 44A and 46A respectively. The turning bars 62 and 64 are disposed closely adjacent to the headbox 42A and the upstream end 50A of the forming section 12A.

The dewatering means 54A also is a curved dewatering shoe which is disposed within a loop defined by the second wire 46A, such that a first portion of water is removed centrifugally through the first wire 44A and a second portion of water is drawn through the second wire 46A.

The transfer means 56A includes a suction roll 66 disposed within a loop defined by the second wire 46A. The suction roll 66 is disposed adjacent to the downstream end 52A of the forming section 12A such that when the wires 44A and 46A diverge relative to each other, the formed web WA is urged into conformity with the second wire 46A while some of the first portion of water is removed from the formed web WA centrifugally through the first wire 44A during passage of the formed web WA around the suction roll 66. Additionally, the second wire 46A is guided about a stationary couch 45.

The press section 14A further includes a further press felt 68 which extends through the pressing section 28A such that the formed web WA is sandwiched between the blanket 30A and the further press felt 68 during passage of the formed web WA through the elongate pressing section 28A. As shown in FIG. 2, the press section 14A is identical to the press section shown in FIG. 1.

FIG. 3 is an enlarged perspective view of the pick-up means 16 shown in FIG. 1 and shows the second wire 46 in cut away section to show the web W. The pick-up roll 18 includes a tail box 70 which extends across a portion of the cross-machine directional width CD of the suction pick-up roll 18 for picking up a tail T of the formed web W from the second wire 46. The tail T is supported by the press felt 20 and thereafter is transferred from the press felt 20 to the bearing blanket 30 for threading through the elongate pressing section 28. The pick-up roll 18 also includes a press vacuum box 71 shown in FIG. 3.

The press means 22 further includes a broke pit 72 shown in FIG. 1. The broke pit 72 is disposed beneath the suction roll 18 such that when the tail T is cut from the formed web W supported by the second wire 46, the remainder R of the full width formed web W shown in FIG. 3 is removed through the broke pit 72 while the tail T follows the press felt 20.

The extended nip press means 22 also includes an upstream guide roll 74 for guiding the bearing blanket 30. The upstream guide roll 74 and the suction pick-up roll 18 define therebetween a transfer nip 76 such that the formed web W is sandwiched between the pres felt 20 and the bearing blanket 30 during passage through the transfer nip 76. Accordingly, the transfer nip 76 is a first press nip defined between the suction roll 18 and the upstream guide roll 74.

FIG. 4 is an enlarged sectional view of the press means 22 shown in FIG. 1 showing the pressing means 26 as a hydrodynamic shoe 78.

FIG. 5 is similar view to that shown in FIG. 4 but shows the pressing means 26B as a hydrostatic shoe 78B.

FIG. 6 is an enlarged sectional view taken on the line 6—6 of FIG. 3 and shows the bearing blanket 30 defining a smooth water impervious surface 80 for supporting the formed web W such that the web W is transferred from the press felt 20 to the smooth surface 80 of the bearing blanket 30 when the bearing blanket 30 diverges relative to the press felt 20.

FIG. 7 is an enlarged sectional view similar to that shown in FIG. 6 but shows an alternative embodiment of the present invention in which a bearing blanket 30C defines a surface 80C for supporting a formed web WC during passage of the web WC through the elongate pressing section. The supporting surface 80C defines a plurality of recesses 82, 83, 84 and 85 for the reception therein of water removed from the formed web WC during passage of the web WC through the elongate pressing section. In the embodiment of FIG. 7, an additional felt 86 is disposed between the surface 80C and the web WC. The additional felt 86 has a surface towards the web that is smoother than the surface towards the web of the felt 20 such that the tail follows the felt 86 when the felt 86 diverges relative to the felt 20.

The press means 22, as shown in FIG. 1, further includes a downstream guide roll 88 for guiding the bearing blanket 30 away from the elongate pressing section 28. The downstream guide roll 8 cooperates with the heated surface 36 of the dryer 34 such that the downstream guide roll 88 and the dryer 34 define therebetween a dryer transfer nip 90 for the passage therethrough of the pressed web W supported by the bearing blanket 30. Therefore, the dryer transfer nip 90 is a third press nip, the first and second press nips being 76 and 28 respectively.

The dryer section 32 also includes a doctor 92, as shown in FIG. 1. The doctor 92 cooperates with the heated surface 36. The doctor 92 is disposed between the blanket 30 and the portion 40 of the heated surface 36 such that in use of the apparatus 10, when the tail T of the formed web W is cut from the full width web W supported by the second wire 46 upstream relative to the suction pick-up roll 18, the tail T is threaded through the press section 14 by application of vacuum through the tail box 70 while the remainder of the full width web falls from the pick-up roll to the broke pit 72. The tail T then transfers from the bearing blanket 30 to the heated surface 36 when the bearing blanket 30 diverges relative to the heated surface 36. Thereafter, the tail T is supported by the heated surface 36 and is subsequently sandwiched between the dryer felt 38 and the dryer 34 so that the tail T is threaded through the dryer 34 and is doctored by doctor 92. Thereafter, the tail doctored from the doctor 92 is blown around transfer means 58 and through dryer section 32.

In operation of the apparatus according to the present invention, the first and second forming wires 44 and 46 are moved at approximately the same velocity as the stock being ejected from the headbox 42. The subsequently formed web is removed downwardly through the broke pit 72.

Subsequently, a tail of the web is cut on the second wire 46 upstream relative to the pick-up means 16. Such tail T is drawn by vacuum within the tail box 70 such that the tail T is urged towards the press felt 20 while the remainder R of the width of the web is removed through the broke pit 72.

The tail T extends through the transfer nip 76 and is transferred to the smooth, impervious surface 80 of the bearing blanket 30 and is guided by the blanket 30 through the extended press means 22. The tail T then extends through the dryer transfer nip 9 and is transferred to the heated surface 36 of the dryer 34.

The doctor 92 is disposed in the operative position thereof such that the tail T supported by the heated surface 36 is sandwiched between the dryer felt 38 and the dryer 34 and is thereafter doctored from the heated surface 36 by the doctor 92. The arrangement is such that the tail T is threaded through the dryer section 32 which is moving at a comparable velocity to that of the forming section 12.

When the tail T has been threaded through both the pressing section 14 and the dryer section 32, the tail cutter 33 shown in FIG. 3 is moved in a cross-machine direction CD to widen the tail T to a full width web so that the full width web is threaded through both the pressing section 14 and the dryer section 32.

Figure 8:
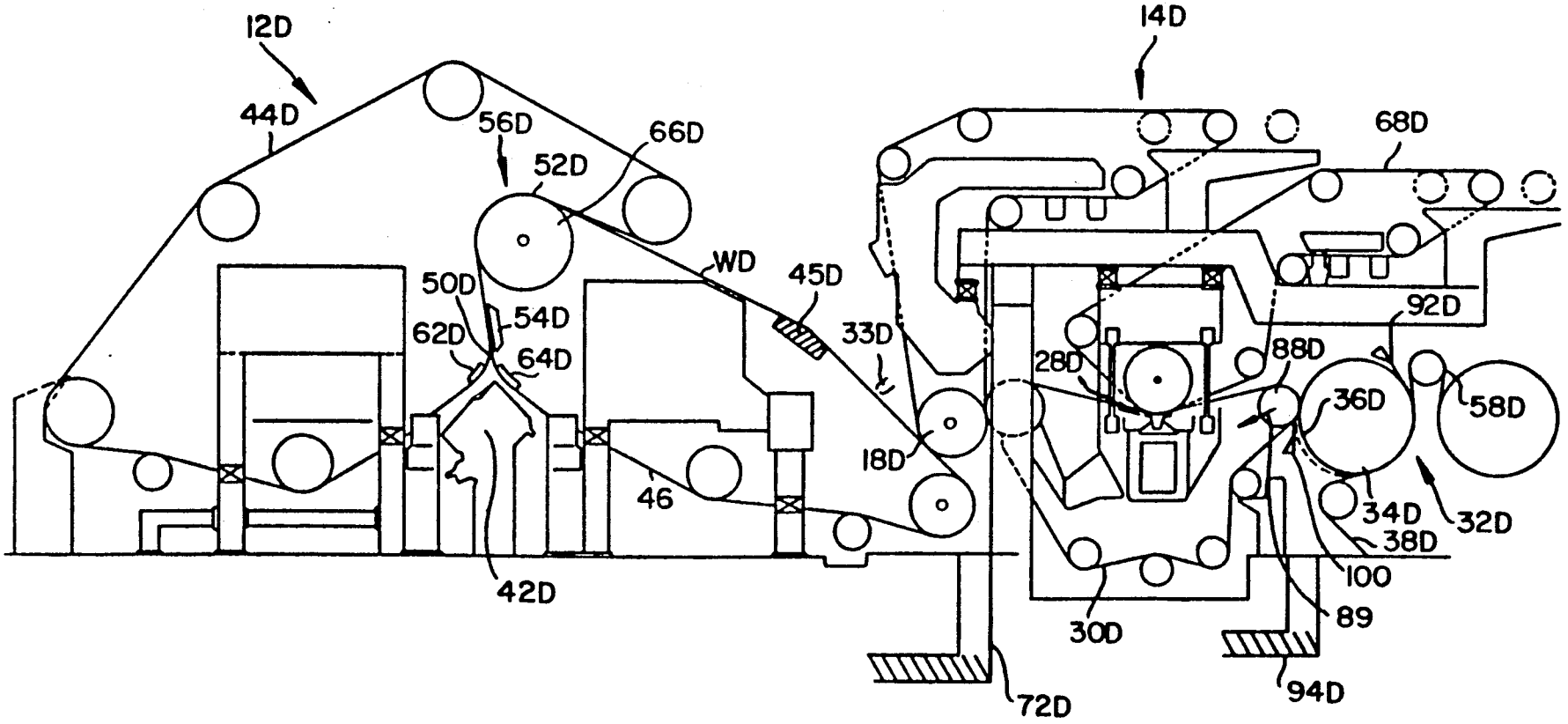
FIG. 8 is a side-elevational view of a further embodiment of the present invention.

In a further embodiment of the present invention, as shown in FIG. 8, a blanket doctor 100 is disposed downstream relative to the downstream guide roll 88D. The arrangement is such that the sheet can be cut off at the wet end by turning off the vacuum to suction pick-up roll 18D and traversing a tail cutter 33D across the sheet from the back to the front of the machine in a cross-machine direction and letting the formed sheet drop into the pulper 72D.

When the dryer section 32D is cleared, it can then be threaded by swinging the downstream guide roll 88D as shown by the arrow 89 away from the dryer 34D and moving the blanket doctor 100 into the operative position as shown in FIG. 8.

Thereafter, the tail cutter 33D cuts a tail of the web WD, and the downstream guide roll 88D is swung back into a slightly spaced relationship with the dryer 34D until the tail has been stabilized through the press section 14D. The arrangement is such that, thereafter, the tail is blown from the doctor 100 into the converging nip defined between the dryer 34D and the dryer felt 38D so that movement of the tail from the blanket 30D onto the hot surface 36 of the dryer 34D is permitted. Thereafter, the tail is doctored by doctor 92D and is blown around the transfer means 58D.

Thereafter, the guide roll 88D is moved to a position in which it nips against the dryer 34D, and the tail is widened to full width, and the blanket doctor 100 is moved to the inoperative position once the full width web is being guided through the dryer section 32D.

Alternatively, a full-width sheet can be established through the press section 14D and stabilized in the following manner.

The tail can be established on the downstream guide roll 88D and its associated doctor 100 when the roll 88D is in the aforementioned slightly swung-back disposition thereof as described hereinbefore. The tail can then be widened to a full width, and the full-width sheet can be run in the press section 14D until a stabilized condition is reached.

The tail cutter, having been shut off, can be moved back across the sheet to the tailing position and then turned on, thus establishing a full-width sheet with a tail cut in it at the doctor 100.

The tail can then be blown to the converging nip defined between dryer 34D and dryer felt 38D where it is established in the dryer section 32D as outlined hereinbefore.

The sheet can then be widened to a full width through the dryer section 32D, and guide roll 88D can then be nipped against the hot surface 36D of the dryer 34D at which time the apparatus 12D, 14D and 32D operate without any open draws.

The present invention provides an apparatus which not only enables automatic threading of a web from the press to the dryer sections but also eliminates any open draws of the web, thereby inhibiting fluttering of the web.

What is claimed:

1. An apparatus for manufacturing a dried web of paper from stock, the web being positively supported during passage through said apparatus, said apparatus comprising:

a forming section for forming the web from the stock;

a press section disposed downstream relative to said forming section for removing a portion of water from the formed web, said press section including:

pick-up means disposed downstream relative to said forming section for picking up the formed web from said forming section;

said pick-up means including:

a suction pick-up roll;

a press felt extending around said suction pickup roll and arranged such that in use of the apparatus, the formed web is picked up from said forming section and is supported by said press felt;

an extended nip press means disposed downstream relative to said pick-up means for removing a part of said portion of water from the formed web;

said press means including:

a rotatable backing roll;

a pressing means cooperating with said backing roll for defining therebetween an elongate pressing section;

a water impervious bearing blanket movably extending through said pressing section, said blanket cooperating with said suction pick-up roll and arranged such that the formed web is directly transferred in a closed draw from said press felt to said blanket at said suction pick-up roll in a transfer nip, the web thereafter extending through said pressing section for removing said part of said portion of water from the web;

a dryer section disposed downstream relative to said press section, for drying the pressed web, said dryer section including:

a rotatable dryer including means for heating its surface which cooperates with said blanket and is arranged such that the pressed web is directly transferred in a closed draw from said blanket to said heated surface of said dryer in a dryer transfer nip; and a dryer felt extending around a portion of said heated surface, said portion being disposed downstream relative to said blanket such that the web is sandwiched between said dryer felt and said dryer.

2. An apparatus for manufacturing a dried web of paper from stock, the web being positively supported during passage through said apparatus, said apparatus comprising:

a forming section for forming the web from the stock, said forming section including:

a headbox;

a first and second moving endless looped forming wire cooperating together to define therebetween a forming section, said forming section having an upstream and a downstream end, said upstream end being disposed closely adjacent to said headbox for receiving the stock ejected therefrom;

dewatering means disposed between said upstream and downstream ends for progressively removing a first and second portion of water from the stock moving through said forming section, said first and second portions of water being removed through said first and second wires respectively;

transfer means disposed adjacent to said downstream end of said forming section for positively urging the formed web into close conformity with said second wire when said wires diverge relative to each other;

a press section disposed downstream relative to said forming section for removing a third portion of water from the formed web, said press section including:

pick-up means disposed downstream relative to said transfer means for picking up the formed web from said second wire;

said pick-up means including:

a suction pick-up roll;

a press felt extending around said suction pick-up roll and arranged such that in use of the apparatus, the formed web is picked up from said second wire and is supported by said press felt;

an extended nip press means disposed downstream relative to said pick-up means for removing a part of said third portion of water from the formed web;

said press means including:

a rotatable backing roll;

a pressing means cooperating with said backing roll for defining therebetween an elongate pressing section;

a water impervious bearing blanket movably extending through said pressing section, said blanket cooperating with said suction pick-up roll and arranged such that the formed web is directly transferred in a closed draw from said press felt to said blanket at said suction pick-up roll in a transfer nip, the web thereafter extending through said pressing section for removing said part of said third portion of water from the web;

a dryer section disposed downstream relative to said press section, for drying the pressed web, said dryer section including:

a rotatable dryer including means for heating its surface which cooperates with said blanket and is arranged such that the pressed web is directly transferred in a closed draw from said blanket to said heated surface of said dryer in a dryer transfer nip;

a dryer felt extending around a portion of said heated surface, said portion being disposed downstream relative to said blanket such that the web is sandwiched between said dryer felt and said dryer;

a vacuum transfer means disposed downstream relative to said dryer for guiding said dryer felt and web supported thereon away from said dryer; and a further dryer disposed downstream relative to said vacuum transfer means, said dryer felt and the web moving contiguously relative to each other from said vacuum transfer means to said further dryer, said dryer and further dryer being disposed as a single tier, the arrangement being structured and arranged such that the web is positively supported from said upstream end of said forming section to said further dryer for permitting automatic threading of the web through said press and dryer sections.

3. An apparatus as set forth in claim 2 wherein said forming section further includes:

a first and second turning bar disposed respectively within a loop formed by said first and second wires respectively, said turning bars being disposed closely adjacent to said headbox and said upstream end of said forming section.

4. An apparatus as set forth in claim 2 wherein said dewatering means includes:

a dewatering shoe disposed within a loop defined by said second wire.

5. An apparatus as set forth in claim 2 wherein said transfer means includes:

a suction roll disposed within a loop defined by said second wire, said suction roll being disposed adjacent to said downstream end of said forming section such that when said wires diverge relative to each other, the formed web is urged into conformity with said second wire while some of said first portion of water is removed from the formed web centrifugally through said first wire during passage of the formed web around said suction roll.

6. An apparatus as set forth in claim 2 wherein said press section further includes:

a further press felt extending through said pressing section such that the formed web is sandwiched between said blanket and said further press felt during passage of the formed web through said elongate pressing section.

7. An apparatus as set forth in claim 2 wherein said suction pick-up roll includes:

a tail box extending across a portion of the cross-machine directional width of said suction pick-up roll for picking up a tail of the formed web from said second wire, said tail being supported by said press felt and thereafter being transferred from said press felt to said bearing blanket for threading through said elongate pressing section.

8. An apparatus as set forth in claim 7 wherein said press section further includes:

a broke pit disposed beneath said suction roll such that when said tail is cut from the formed web supported by said second wire, the remainder of the full width formed web is removed through said broke pit while said tail follows said press felt.

9. An apparatus as set forth in claim 2 wherein said extended nip press means further includes:

an upstream guide roll for guiding said bearing blanket, said upstream guide roll and said suction pick-up roll defining therebetween said transfer nip such that the formed web is sandwiched between said press felt and said bearing blanket during passage through said transfer nip.

10. An apparatus as set forth in claim 9 wherein said bearing blanket defines a smooth water impervious surface for supporting the formed web such that the web is transferred from said press felt to said smooth surface of said bearing blanket when said bearing blanket diverges relative to said press felt.

11. An apparatus as set forth in claim 2 wherein said pressing means is a hydrodynamic shoe.

12. An apparatus as set forth in claim 2 wherein said pressing means is a hydrostatic shoe.

13. An apparatus as set forth in claim 2 wherein said bearing blanket defines a surface for supporting the formed web during passage of the web through said elongate pressing section, said supporting surface defining a plurality of recesses therein for the reception of water removed from the formed web during passage of the web through said elongate pressing section.

14. An apparatus as set forth in claim 2 wherein said press section further includes:

a downstream guide roll for guiding said bearing blanket away from said elongate pressing section, said downstream guide roll cooperating with said heated surface of said dryer such that said downstream guide roll and said dryer define therebetween said dryer transfer nip for the passage therethrough of the pressed web supported by said bearing blanket.

15. An apparatus as set forth in claim 2 wherein said dryer section further includes:

a doctor disposed downstream relative to said bearing blanket and said portion of said heated surface, said doctor cooperating with said heated surface, said doctor being disposed such that in use of said apparatus, when a tail of the formed web is cut from the full width web supported by said second wire upstream relative to said suction pick-up roll, said tail is threaded through said press section and transfers from said bearing blanket to said heated surface when said bearing blanket diverges relative to said heated surface, thereafter said tail is supported by said heated surface and is subsequently sandwiched between said dryer felt and said dryer so that said tail is threaded around said dryer and is doctored therefrom by said doctor.

16. An apparatus as set forth in claim 15 further including:

a tail cutter disposed above said second wire;

a blanket doctor operatively cooperating with said bearing blanket and disposed downstream relative to the divergence of said bearing blanket from said heated surface;

a further broke pit disposed beneath said blanket doctor;

means for swinging said downstream guide roll from a first position in which said guide roll is urged against said dryer to a second position in which said downstream guide roll is spaced relative to said dryer such that a gap is defined between said blanket supported by said downstream guide roll and said dryer, the arrangement being such that in the event of a web breakage in the dryer section, said blanket doctor is moved into operative proximity relative to said bearing blanket and said downstream guide roll is moved to said second position thereof spaced from said dryer, next, said tail cutter is moved in a cross-machine direction across said second wire so that the web is severed transversely, such that the web disposed downstream relative to said transverse severing extends in open draw from said downstream guide roll to and around said dryer while said web disposed upstream relative to said transverse severing follows said blanket from said downstream guide roll to said blanket doctor where the full width web is doctored to said further broke pit, thereafter, a further tail is cut from the web by said tail cutter and such further tail, together with the remainder of the full width web, is doctored to said further broke pit, said downstream guide roll is then moved by said means to a third position closely adjacent to but spaced from the dryer such that blowing of said further tail from said blanket onto said heated surface and between a dryer felt nip defined between said dryer felt and said dryer is permitted, thereafter, said further tail is widened to a full width sheet such that the full width web extends through said press section and subsequently through said dryer section.

17. A method for manufacturing a dried web of paper from stock, the web being positively supported during passage of the web through the forming section, a pressing section, and a drying section, the method comprising the steps of:

forming a web from stock such that the formed web is disposed on a forming wire of the forming section;

cutting a tail of the web on the forming wire upstream relative to a pick-up roll of the press section;

picking up the tail of the web by applying vacuum through a tail box defined by the pick-up roll such that the tail is supported by a press felt while the remainder of the full width web is removed to a broke pit;

directly transferring the tail in a closed draw from said press felt to a smooth, water impervious surface of a bearing blanket at said pick-up roll in a transfer nip, said blanket extending through an extended nip press;

supporting the tail on the impervious surface during passage of the tail through an elongate pressing section;

directly transferring the tail in a closed draw from the bearing blanket to a heated surface of a dryer in a dryer transfer nip;

sandwiching the tail between the dryer and a dryer felt disposed downstream relative to the bearing blanket such that the tail is threaded through the press section and the dryer section; and subsequently widening the tail to a full width web such that the full width web is threaded through the press section and dryer section, the web being transferred without open draw from the forming section to the dryer section.

* * * * *

UNITED STATES PATENT AND TRADEMARK OFFICE

CERTIFICATE OF CORRECTION

PATENT NO. : 5,087,325

DATED : February 11, 1992

INVENTOR(S) : Robert E. Page

It is certified that error appears in the above—identified patent and that said Letters Patent is hereby corrected as shown below:

| | |
|---|---|
| Column 7, Line 47: | Please delete "removably" and insert therefor ---removing---. |
| Column 9, Line 68: | Please delete "pres" and insert therefor ---press---. |
| Column 10, Line 37: | Please delete "8" and insert therefor ---88---. |
| Column 11, Line 13: | Please delete "9" and insert therefor ---90---. |
| Column 11, Line 51: | Please delete "36" and insert therefor ---36D---. |

Signed and Sealed this

Fourth Day of May, 1993

*Attest:*

Michael K. Kirk

MICHAEL K. KIRK

*Attesting Officer*

*Acting Commissioner of Patents and Trademarks*